US012215448B2

(12) United States Patent
Nakamura et al.

(10) Patent No.: US 12,215,448 B2
(45) Date of Patent: Feb. 4, 2025

(54) FIBER ASSEMBLY AND METHOD FOR PRODUCING FIBER ASSEMBLY

(71) Applicant: Panasonic Intellectual Property Management Co., Ltd., Osaka (JP)

(72) Inventors: Taichi Nakamura, Osaka (JP); Norihito Tsukahara, Kyoto (JP); Kouji Ikeda, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 339 days.

(21) Appl. No.: 17/700,961

(22) Filed: Mar. 22, 2022

(65) Prior Publication Data

US 2022/0341071 A1 Oct. 27, 2022

(30) Foreign Application Priority Data

Apr. 23, 2021 (JP) ..... 2021-073546

(51) Int. Cl.
*D04H 3/04* (2012.01)
*D01D 5/08* (2006.01)
(Continued)

(52) U.S. Cl.
CPC ..... *D04H 3/04* (2013.01); *D01D 5/08* (2013.01); *D04H 3/005* (2013.01); *D04H 3/14* (2013.01); *D10B 2321/121* (2013.01)

(58) Field of Classification Search
CPC ..... D04H 3/04; D04H 3/005; D04H 3/14; D01D 5/08; D10B 2321/121; A61L 27/58;
(Continued)

(56) References Cited

U.S. PATENT DOCUMENTS

2004/0267362 A1* 12/2004 Hwang ..... A61L 27/3645 623/13.17
2007/0041952 A1* 2/2007 Guilak ..... A61L 27/58 623/1.11
(Continued)

FOREIGN PATENT DOCUMENTS

JP 2019-024340 2/2019
JP 2020-079459 5/2020
(Continued)

OTHER PUBLICATIONS

Gao et al., "3D printed multi-scale scaffolds with ultrafine fibers for providing excellent biocompatibility," Materials Science & Engineering C 107 (2020) 110269 (Year: 2020).*

*Primary Examiner* — Jeremy R Pierce
(74) *Attorney, Agent, or Firm* — Wenderoth, Lind & Ponack, L.L.P.

(57) ABSTRACT

A fiber assembly includes a support sheet, a warp yarn group in which warp yarns including a polymer material are arranged, and a weft yarn group in which weft yarns including a polymer material are arranged. A surface of the support sheet has been subjected to a release treatment. The warp yarn group and the weft yarn group are on the surface of the support sheet. The warp yarn group and the weft yarn group define contact portion regions and non-contact portion regions. In each of the contact portion regions, one of the warp yarns is integrated with one of the weft yarns. Each of the warp yarns and the weft yarns has a line width of 1 μm to 10 μm, inclusive. One of the contact portion regions has a fiber density which is higher than a fiber density of one of the non-contact portion regions.

5 Claims, 13 Drawing Sheets

(51) Int. Cl.
*D04H 3/005* (2012.01)
*D04H 3/14* (2012.01)

(58) Field of Classification Search
CPC . A61L 27/3804; A61L 27/3645; A61L 31/148
See application file for complete search history.

(56) References Cited

U.S. PATENT DOCUMENTS

| | | | | |
|---|---|---|---|---|
| 2014/0222162 | A1* | 8/2014 | Seedhom | A61L 27/3804 623/23.72 |
| 2015/0140289 | A1* | 5/2015 | Ferro | A61F 2/00 428/195.1 |
| 2017/0014551 | A1* | 1/2017 | Sambusseti | A61L 31/148 |
| 2021/0403850 | A1 | 12/2021 | Takezawa | |

FOREIGN PATENT DOCUMENTS

| | | | | |
|---|---|---|---|---|
| JP | 2020-079460 | | 5/2020 | |
| WO | WO-2016107522 | A1 * | 7/2016 | A61B 17/00 |
| WO | 2018/135252 | | 7/2018 | |

* cited by examiner

FIBER ASSEMBLY AND METHOD FOR PRODUCING FIBER ASSEMBLY

BACKGROUND

1. Technical Field

The present invention relates to a fiber assembly including a plurality of intersecting fibers, and a method for producing the fiber assembly.

2. Description of the Related Art

In recent years, fiber substrates have been attracting attention as culture scaffolds for culturing biological tissues and microorganisms. In particular, in the case where the growth of biological tissues and microorganisms is directional, it is desirable that the fibers constituting the fiber substrates are arranged in a certain direction, and there is known a method of improving the arrangement of the fibers by accumulating the fibers so as to circulate around a peripheral surface of a winding rotating body (see, for example, Japanese Patent Unexamined Publication No. 2020-79460).

In the method for producing a fiber assembly disclosed in Japanese Patent Unexamined Publication No. 2020-79460, the arrangement of fibers is excellent, but when fibers arranged on a support sheet and having a small line width of 10 μm or less are cut into individual pieces, the fibers are frayed and the cut fibers of a divided portion are entangled, which is a factor that inhibits the arrangement.

For example, as a case, fibers having a line width of φ16 μm (φ16 fibers) are compared with fibers having a line width of φ1 μm (φ4 fibers). Since a contact area of fibers with respect to the support sheet is proportional to the first power of the line width, a contact area of the fibers of φ4 μm is ¼ of a contact area of the φ16 fibers. On the other hand, since a tensile rigidity of fibers is proportional to the square of the line width, a tensile rigidity of the fibers of φ4 μm is 1/16 of a tensile rigidity of the φ16 fibers. Accordingly, it is necessary to use a support sheet having a weak adhesive force (peeling force) in order to peel off fibers having a smaller line width from the support sheet, which means that the cut fibers of the divided portion are likely to be loosened and entangled.

SUMMARY

The present disclosure has been made in view of the above, and an object of the present disclosure is to provide a fiber assembly in which cut fibers after being cut into individual pieces are less likely to be entangled in a dense portion for practical use.

A fiber assembly according to an aspect of the invention includes, on a main surface of a support sheet subjected to a release treatment, a warp yarn group in which a plurality of warp yarns including a polymer material are arranged, and a weft yarn group in which a plurality of weft yarns including a polymer material are arranged. The warp yarn group and the weft yarn group form a plurality of first contact portion regions and a plurality of non-contact portion regions. Each of the plurality of first contact portion regions is a region in which at least one of the plurality of warp yarns is integrated with at least one of the plurality of weft yarns. Each of the plurality of warp yarns has a line width of 1 μm to 10 μm, inclusive, and each of the plurality of weft yarns has a line width of 1 μm to 10 μm, inclusive.

At least one of the plurality of first contact portion regions has a fiber density higher than a fiber density of at least one of the plurality of non-contact portion regions. Two of the plurality of warp yarns or two of the plurality of weft yarns have a spacing of 5 μm or more and 1000 μm or less in at least one of the plurality of first contact portion regions. Two of the plurality of warp yarns or two of the plurality of weft yarns have a spacing of 2000 μm or more in at least one of the plurality of non-contact portion regions.

A method for producing a fiber assembly according to an aspect of the invention includes: a step of forming a first layer by relatively moving a nozzle that supplies fibers including a polymer material in a direction parallel to a rotation shaft with respect to a support sheet that is wound around a rotating body in a cylindrical shape and fixed to the rotating body to rotate, and spinning the fibers on the support sheet so as to include a portion having a high fiber density and having a spacing of 5 μm to 1000 μm between adjacent fibers, and a portion having a low fiber density and having a spacing of 2000 μm or more between adjacent fibers; a step of forming a second layer by relatively moving the nozzle that supplies the fibers including a polymer material in the direction parallel to the rotation shaft with respect to the support sheet that is wound around and fixed to the rotating body to rotate such that a direction in which the support sheet is wound around the rotating body intersects with a spinning direction of the first layer, and spinning the fibers on the support sheet so as to include a portion having a high fiber density and having a spacing of 5 μm to 1000 μm between adjacent fibers, and a portion having a low fiber density and having a spacing of 2000 μm or more between adjacent fibers; and a step of heating the support sheet, on which the first layer and the second layer are spun, at a temperature equal to or higher than a melting point of the polymer material.

According to the fiber assembly according to the aspect of the invention, the fibers arranged on the support sheet are formed in a state in which the fibers in portions for practical use are dense and the fibers in individual cut portions are sparse so that a sparse-and-dense pattern can be visually recognized. Therefore, by passing a blade in the portions having a low fiber density at the time of individual cutting, it is possible to prevent the cut fibers of the divided portion from being entangled in the portions for practical use having a high fiber density.

DETAILED DESCRIPTIONS

Figure 1:
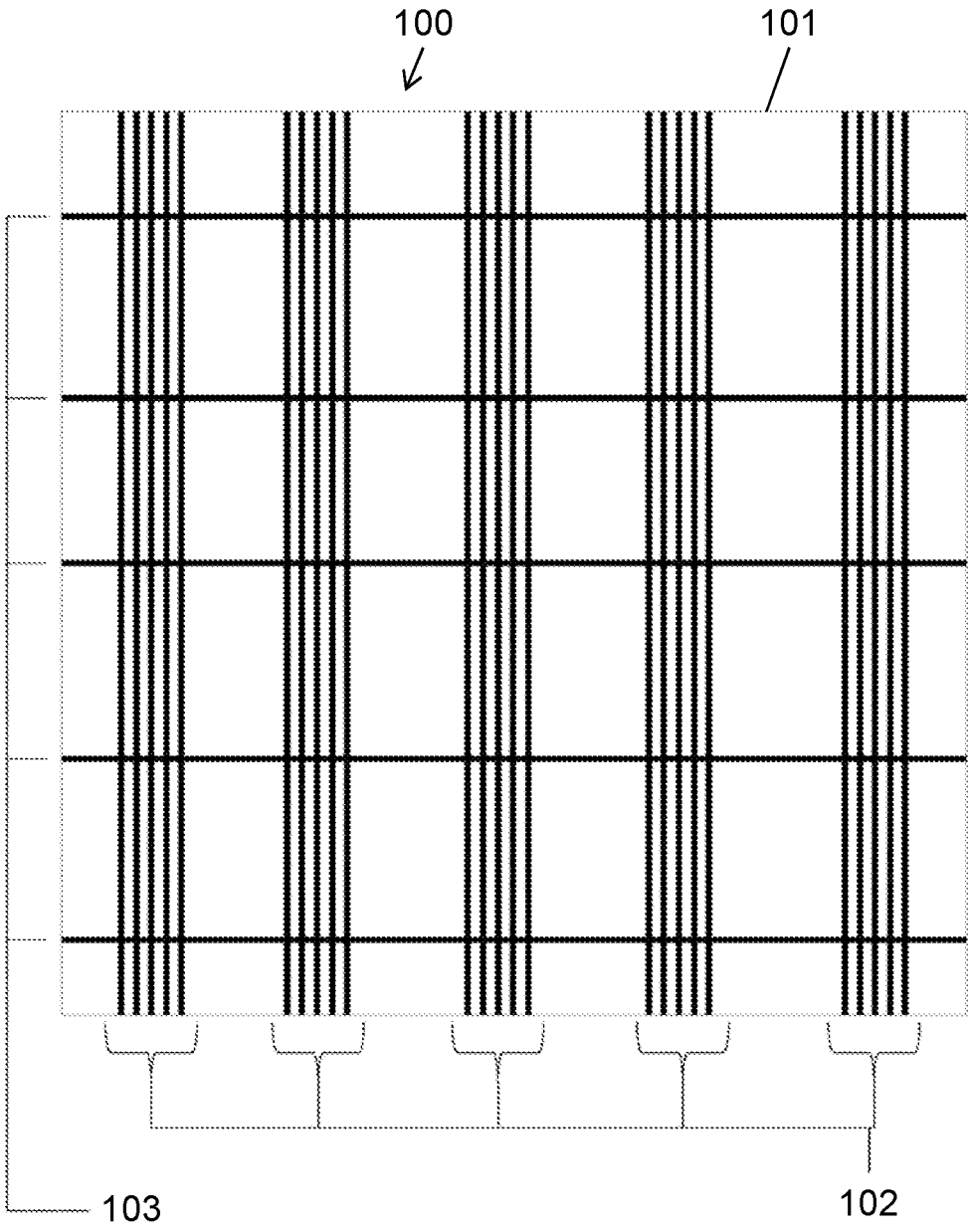
FIG. 1 is an enlarged schematic view of a fiber assembly according to a first embodiment, in which a warp yarn group has a pattern of high fiber density and a pattern of low fiber density, and a weft yarn group has only a pattern of low fiber density.

A fiber assembly according to a first aspect of the invention includes, on a main surface of a support sheet subjected to a release treatment, a warp yarn group in which a plurality of warp yarns including a polymer material are arranged, and a weft yarn group in which a plurality of weft yarns including a polymer material are arranged.

The warp yarn group and the weft yarn group form a plurality of first contact portion regions and a plurality of non-contact portion regions.

Each of the plurality of first contact portion regions is a region in which at least one of the plurality of warp yarns is integrated with at least one of the plurality of weft yarns.

Each of the plurality of warp yarns has a line width of 1 μm to 10 μm, inclusive, and each of the plurality of weft yarns has a line width of 1 μm to 10 μm, inclusive.

At least one of the plurality of first contact portion regions has a fiber density higher than a fiber density of at least one of the plurality of non-contact portion regions.

Two of the plurality of warp yarns or two of the plurality of weft yarns have a spacing of 5 μm or more and 1000 μm or less in at least one of the plurality of first contact portion regions.

Two of the plurality of warp yarns or two of the plurality of weft yarns have a spacing of 2000 μm or more in at least one of the plurality of non-contact portion regions.

In the fiber assembly according to a second aspect based on the above-described first aspect, at least one of the plurality of non-contact portion regions may include a second contact portion region in which one or more and three or less oblique warp yarns not parallel to the plurality of warp yarns are integrated with at least one of the plurality of weft yarns.

In the fiber assembly according to a third aspect based on the above-described first aspect, at least one of the plurality of non-contact portion regions may include a second contact portion region in which one or more and three or less oblique weft yarns not parallel to the plurality of weft yarns are integrated with at least one of the plurality of warp yarns.

A method for producing a fiber assembly according to a fourth aspect includes a step of forming a first layer by relatively moving a nozzle that supplies fibers including a polymer material in a direction parallel to a rotation shaft with respect to a support sheet that is wound around a rotating body in a cylindrical shape and fixed to the rotating body to rotate, and spinning the fibers on the support sheet so as to include a portion having a high fiber density and having a spacing of 5 μm to 1000 μm between adjacent fibers, and a portion having a low fiber density and having a spacing of 2000 μm or more between adjacent fibers, a step of forming a second layer by relatively moving the nozzle that supplies the fibers including a polymer material in the direction parallel to the rotation shaft with respect to the support sheet that is wound around and fixed to the rotating body to rotate such that a direction in which the support sheet is wound around the rotating body intersects with a spinning direction of the first layer, and spinning the fibers on the support sheet so as to include a portion having a high fiber density and having a spacing of 5 μm to 1000 μm between adjacent fibers, and a portion having a low fiber density and having a spacing of 2000 μm or more between adjacent fibers, and a step of heating the support sheet, on which the first layer and the second layer are spun, at a temperature equal to or higher than a melting point of the polymer material.

In the method for producing a fiber assembly according to a fifth aspect based on the above-described fourth aspect, a plurality of nozzles arranged in a direction parallel to a direction of the rotation shaft may be used in at least one of the step of forming the first layer and the step of forming the second layer.

A fiber assembly according to an embodiment will be described below with reference to the accompanying drawings. In the drawings, substantially the same members are denoted by the same reference numerals.

First Embodiment

Fiber Assembly

A fiber assembly according to a first embodiment includes, on a main surface of a support sheet subjected to a release treatment, a warp yarn group in which a plurality of warp yarns made of a polymer material are arranged, and a weft yarn group in which a plurality of weft yarns made of a polymer material are arranged. The warp yarn group and the weft yarn group form a plurality of first contact portion regions and a plurality of non-contact portion regions. Each of the plurality of first contact portion regions is a region in which at least one of the plurality of warp yarns is integrated with at least one of the plurality of weft yarns. Each of the plurality of warp yarns has a line width of 1 μm to 10 μm, and each of the plurality of weft yarns has a line width of 1 μm to 10 μm. At least one of the plurality of first contact portion regions has a fiber density higher than that of at least one of the plurality of non-contact portion regions. Two of the plurality of warp yarns or two of the plurality of weft yarns have a spacing of 5 μm or more and 1000 μm or less in at least one first contact portion region. Two of the plurality of warp yarns or two of the plurality of weft yarns have a spacing of 2000 μm or more in at least one non-contact portion region.

The fiber assembly according to the first embodiment will be described in detail below with reference to the accompanying drawings.

FIGS. 1 to 8 are enlarged schematic views of a main surface of the fiber assembly according to the first embodiment.

Fiber assembly 100 according to the first embodiment includes support sheet 101, and warp yarn group 102 and weft yarn group 103 arranged on a main surface of support sheet 101. Warp yarn group 102 includes a plurality of warp yarns. Weft yarn group 103 includes a plurality of weft yarns.

Support Sheet

A PET film having a thickness of 75 μm is used as support sheet 101, and the main surface thereof is subjected to a release treatment (not shown) with a fluorine material.

The reason why a film subjected to a release treatment is used as support sheet 101 will be described in detail in a method for producing a fiber assembly described later.

Warp Yarn Group and Weft Yarn Group

Polystyrene is used as a polymer material that is a material of warp yarn group 102 and weft yarn group 103, and a line width thereof is 2 μm.

Materials of warp yarn group 102 (and oblique warp yarns 202 described later) and weft yarn group 103 (and oblique weft yarns 203 described later) can be produced by a spinning method described later. Examples of a material that can be made into a solution and spun include not only polystyrene but also silicone, polyurethane, and silicone-polyurethane copolymer collagen. Examples of a material that can be melted and spun include polylactide (PLA), poly-L-lactic acid (PLLA), polyglycolide (PGA), and lactic acid-glycolic acid copolymer (PLGA). However, the materials are not limited thereto, and an inorganic filler may be dispersed in a material containing a polymer as a main component to provide, for example, a certain degree of conductivity. Warp yarn group 102 (and oblique warp yarns 202 described later) and weft yarn group 103 (and oblique weft yarns 203 described later) may be formed of the same material or may be formed of a combination of different materials.

As will be described later, it is necessary to integrate the contact portions between the warp yarn group and the weft yarn group, and the candidate materials listed here have thermoplasticity and satisfy integration due to heat fusion.

The line width of the warp yarn means an average thickness of a cross section perpendicular to a longitudinal direction of the warp yarn. The line width of the weft yarn means an average thickness of a cross section perpendicular to a longitudinal direction of the weft yarn. For example, when used as a scaffold for culturing cells as biological tissues on a lattice formed by warp yarn group 102 and weft yarn group 103, the warp yarn and the weft yarn preferably have a line width of 1 μm to 10 μm from the viewpoint of adhesion of the cells. The thickness may further be 1 μm to 5 μm, 2 μm to 4 μm, etc.

The warp yarn and the weft yarn may have different diameters in a range of 1 μm to 10 μm. In consideration of the planar uniformity of the lattice formed by warp yarn group 102 and weft yarn group 103 and ensuring the strength of the contact portions due to substantial flattening accompanying the heat fusion described later, the warp yarn and the weft yarn preferably have the same diameter.

Spacing between Gaps of Warp Yarn and Weft Yarn

Next, a spacing between the warp yarns of warp yarn group 102 and a spacing between the weft yarns of weft yarn group 103 will be described with reference to FIGS. 1, 2, 3, and 4.

Figure 2:
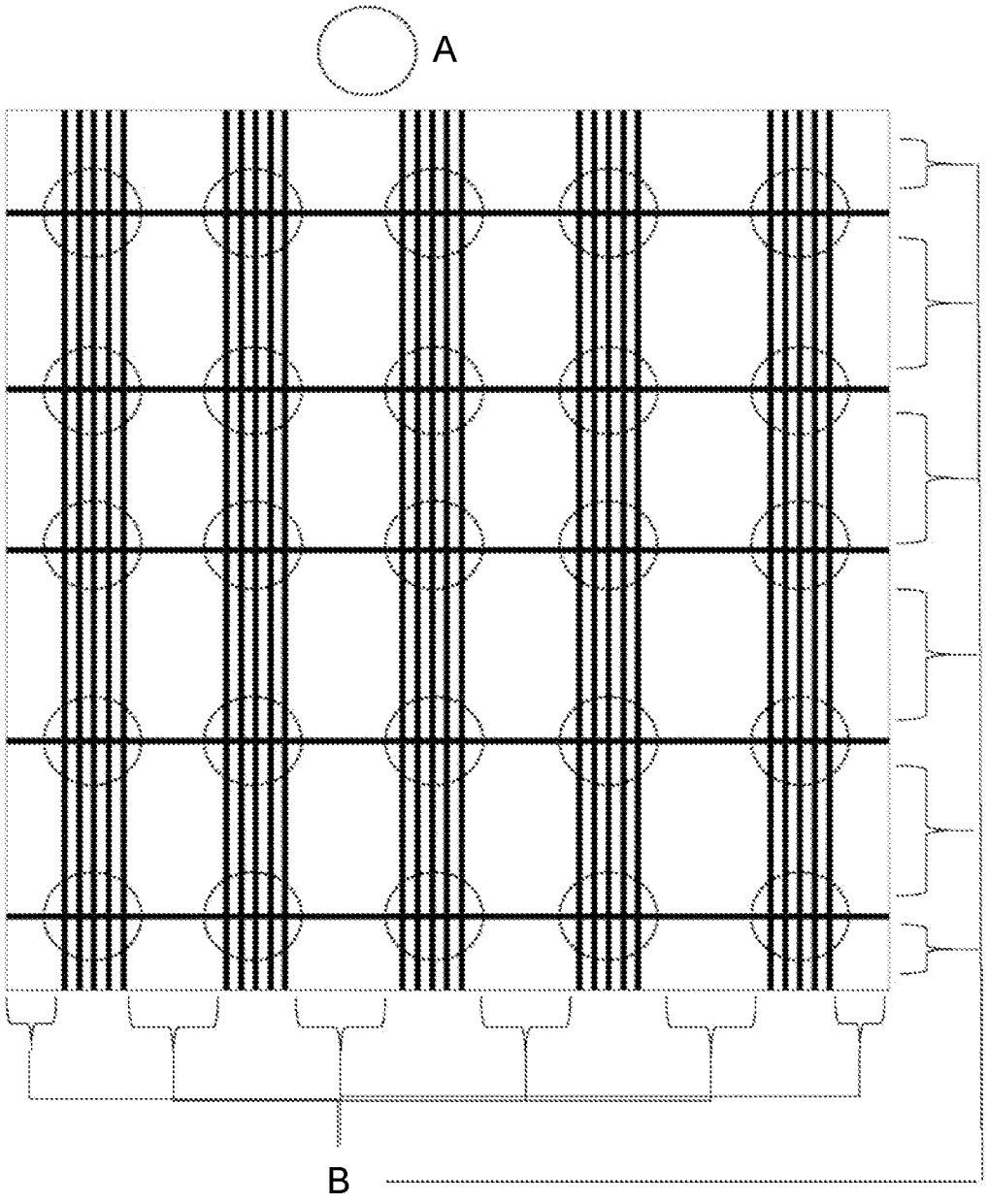
FIG. 2 is a schematic view showing a division between first contact portion regions and non-contact portion regions in the case of FIG. 1.

FIG. 1 shows an example of a fiber assembly in which warp yarn group 102 has a pattern of high fiber density and a pattern of low fiber density, and weft yarn group 103 has only a pattern of low fiber density. FIG. 2 is a schematic view showing a division between first contact portion regions A and non-contact portion regions B in the case of FIG. 1.

In warp yarn group 102 shown in FIG. 1, a portion having a high fiber density has a gap spacing of 5 μm between the warp yarns and a portion having a low fiber density has a gap spacing of 2000 μm between the warp yarns, and a gap spacing between the weft yarns is 2000 μm.

First Modification

Figure 3:
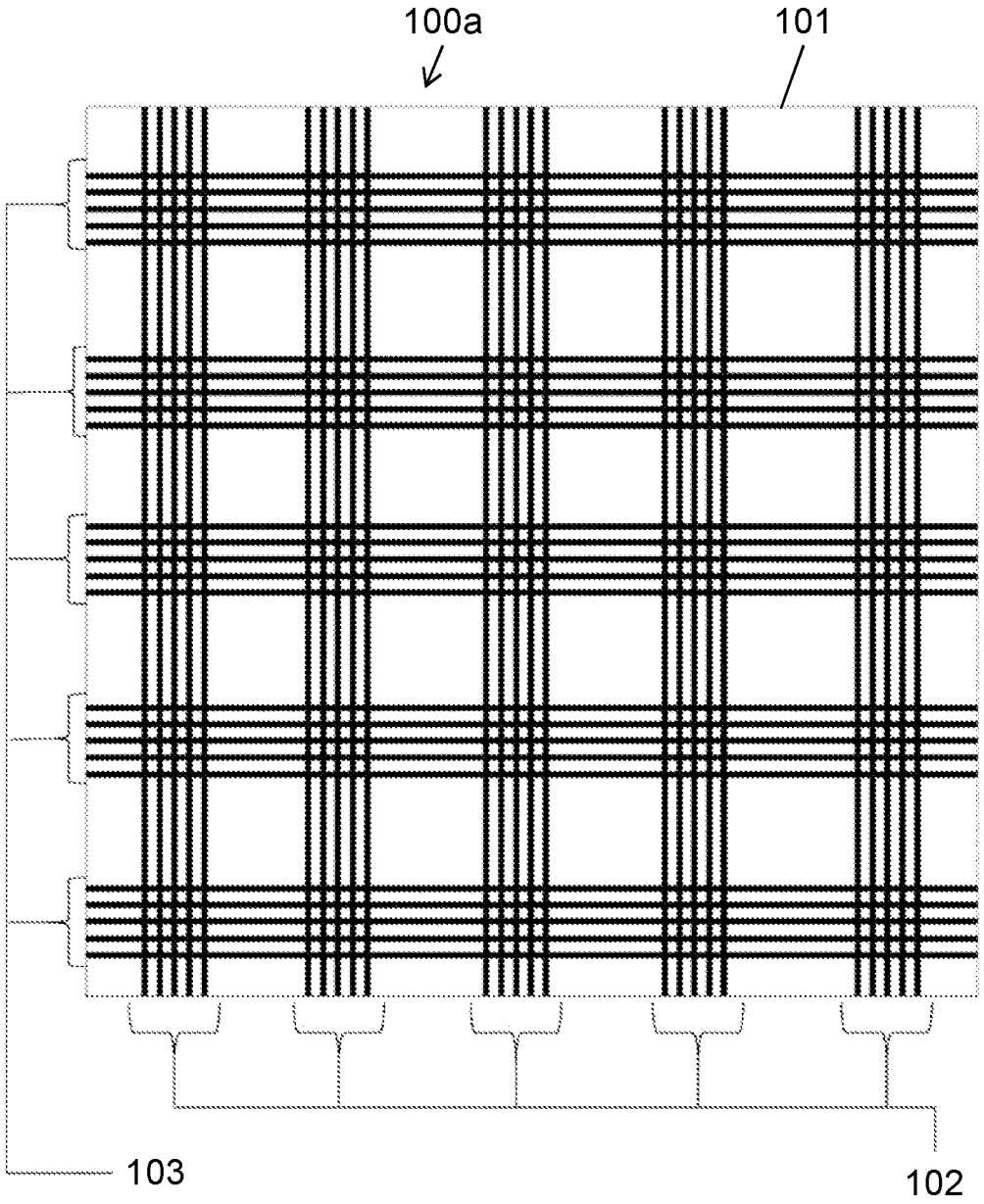
FIG. 3 is an enlarged schematic view of a fiber assembly according to a first modification of the first embodiment, in which both a warp yarn group and a weft yarn group have a pattern of high fiber density and a pattern of low fiber density.
Figure 4:
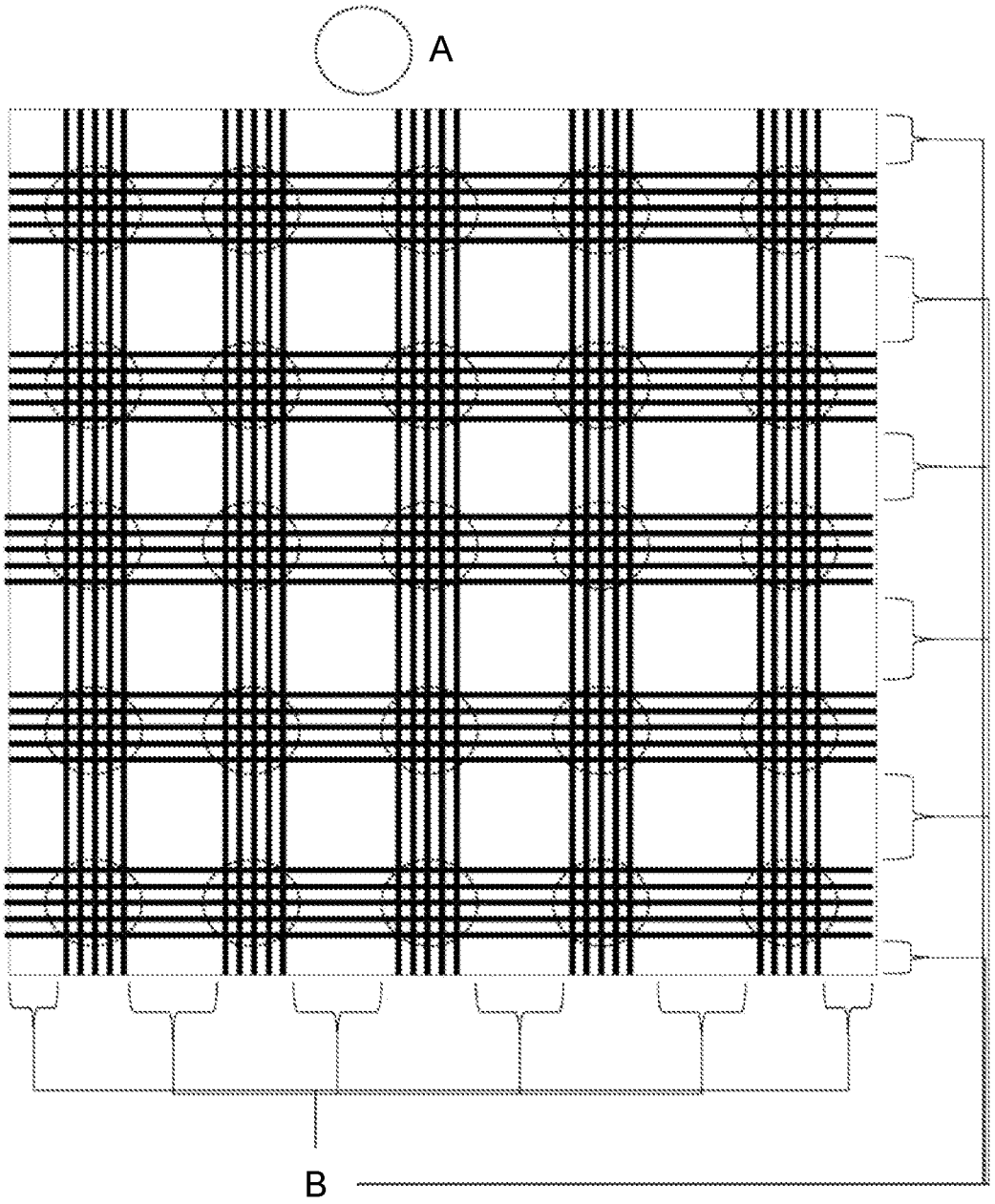
FIG. 4 is a schematic view showing a division between first contact portion regions and non-contact portion regions in the case of FIG. 3.

FIG. 3 is a schematic view of fiber assembly 100*a* according to a first modification of the first embodiment, in which both warp yarn group 102 and weft yarn group 103 have a pattern of high fiber density and a pattern of low fiber density. FIG. 4 is a schematic view showing a division between first contact portion regions A and non-contact portion regions B in the case of FIG. 3.

In FIG. 3, a portion having a high fiber density of warp yarn group 102 has a spacing of 5 μm between the warp yarns, and a portion having a low fiber density has a spacing of 2000 μm between the warp yarns. Similarly, a portion having a high fiber density of weft yarn group 103 has a spacing of 5 μm between the weft yarns, and a portion having a low fiber density has a spacing of 2000 μm between the weft yarns.

Here, the "spacing" means an average distance between edges of adjacent yarns in a direction perpendicular to a longitudinal direction of the yarns.

For example, when used as a scaffold for culturing cells as biological tissues on a lattice formed by warp yarn group 102 and weft yarn group 103, the gap spacing in the portion having a high fiber density is preferably 5 μm to 1000 μm in view of both cases of culturing on the yarns and culturing in an opening portion of the lattice. The gap spacing may further be 5 μm to 500 μm, 5 μm to 200 μm, etc.

The gap spacing in the portion having a low fiber density is required to be visible and allow a blade to pass at the time of individual cutting when portions for practical use are to be cut into individual pieces from fiber assembly 100, and is preferably 2000 μm or more.

Effects

That is, according to the present fiber assembly, by cutting the fiber assembly in the portion having a low fiber density, that is, the non-contact portion region B as shown in FIGS. 2 and 4, cut fibers of the divided portion are less likely to be entangled in the portion having a high fiber density, that is, the first contact portion region A.

FIGS. 1, 2, 3, and 4 show a case where there is no contact portion at the portion having a low fiber density of the warp yarn group or the weft yarn group, that is, at the non-contact portion region B.

Next, FIGS. 5, 6, 7, and 8 illustrate, for example, a case where the portion having a low fiber density of the warp yarn group or the weft yarn group, that is, the non-contact region B includes a second contact portion region that is a region in which oblique warp yarns are integrated with the weft yarns and/or a region in which oblique weft yarns are integrated with the warp yarns.

Second Modification

Figure 5:
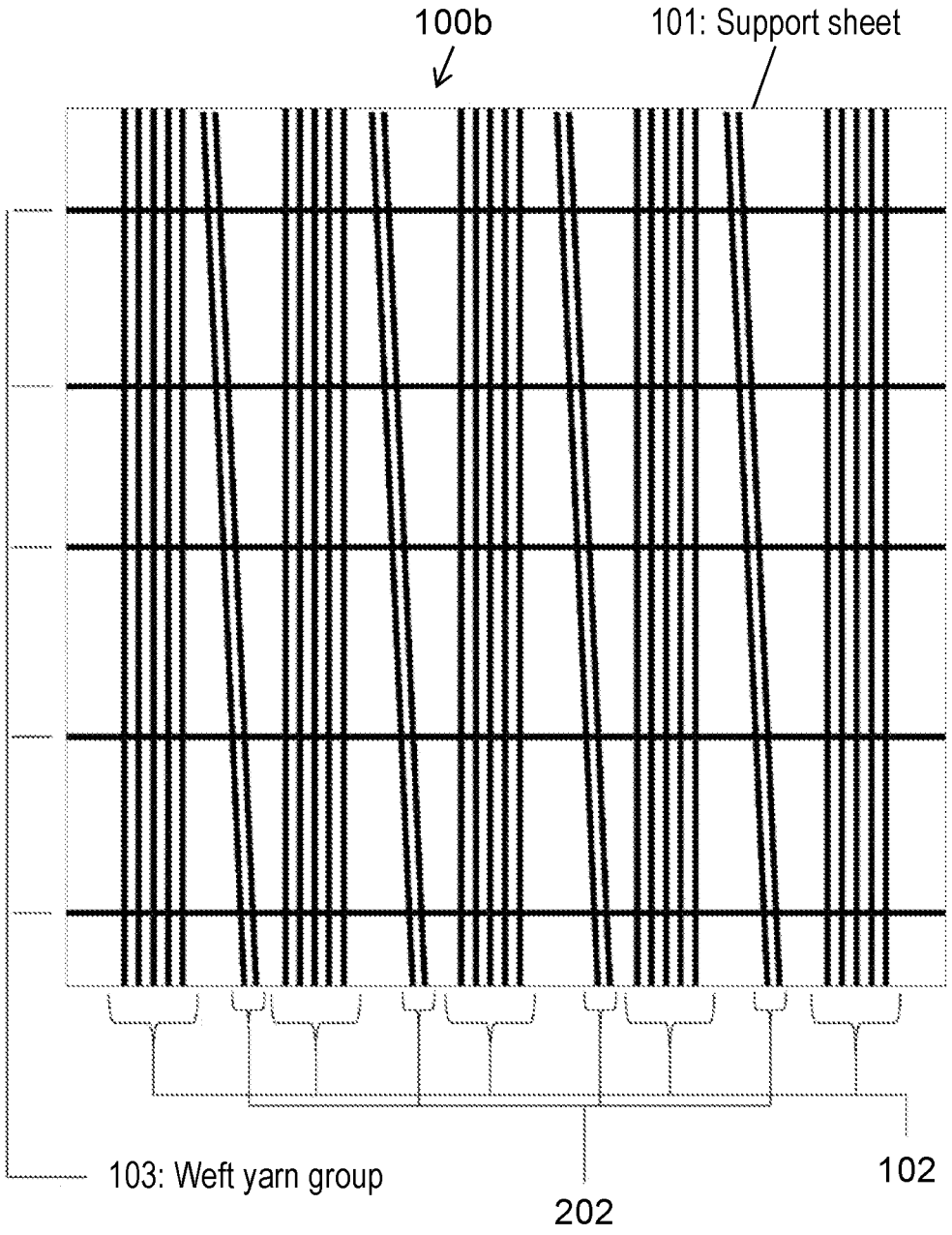
FIG. 5 is an enlarged schematic view of a fiber assembly according to a second modification of the first embodiment, in which a warp yarn group has a pattern of high fiber density and a pattern of low fiber density and oblique warp yarns are provided, and a weft yarn group has only a pattern of low fiber density.
Figure 6:
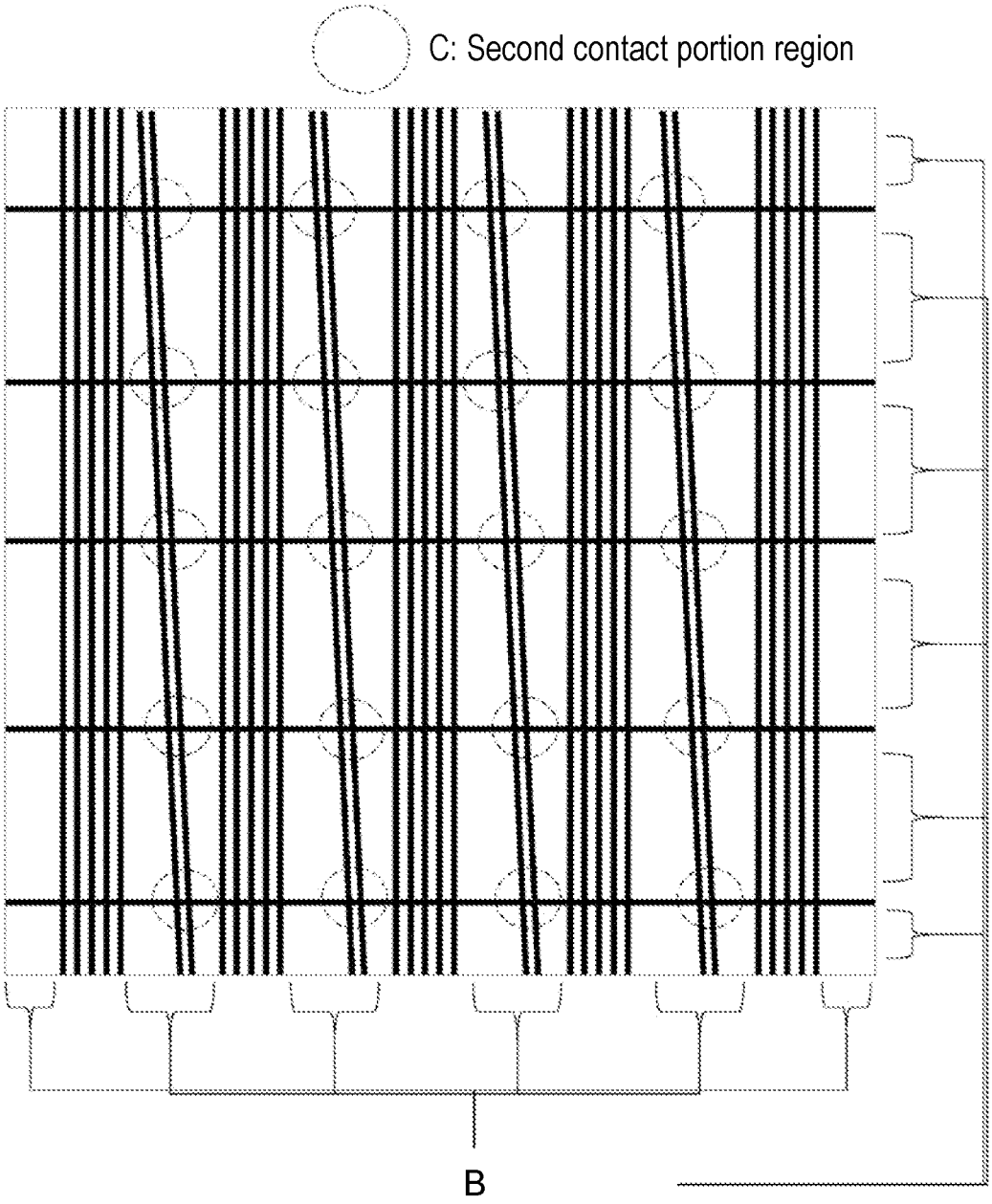
FIG. 6 is a schematic view showing a division of first contact portion regions, non-contact portion regions, and second contact portion regions in the case of FIG. 5.

FIG. 5 is a schematic view of fiber assembly 100*b* according to a second modification of the first embodiment, in which warp yarn group 102 has a pattern of high fiber density and a pattern of low fiber density and oblique warp yarns 202 are provided, and weft yarn group 103 has only a pattern of low fiber density. FIG. 6 is a schematic view showing a division between first contact portion regions A, non-contact portion regions B, and second contact portion regions C in the case of FIG. 5.

In FIG. 5, a portion having a high fiber density of warp yarn group 102 has a spacing of 5 μm between the warp yarns, and weft yarn group 103 has a spacing of 2000 μm between the weft yarns.

In addition, as shown in FIG. 5, two oblique warp yarns 202 that are not parallel to the warp yarns are sandwiched between two adjacent dense portions of the warp yarn group. Although oblique warp yarns 202 and the warp yarns are not parallel to each other, an angle formed therebetween is small, and is, for example, 30 degrees or less. Accordingly, as shown in FIG. 6, non-contact portion region B includes second contact portion region C in which oblique warp yarns 202 are integrated with the weft yarn.

Third Modification

Figure 7:
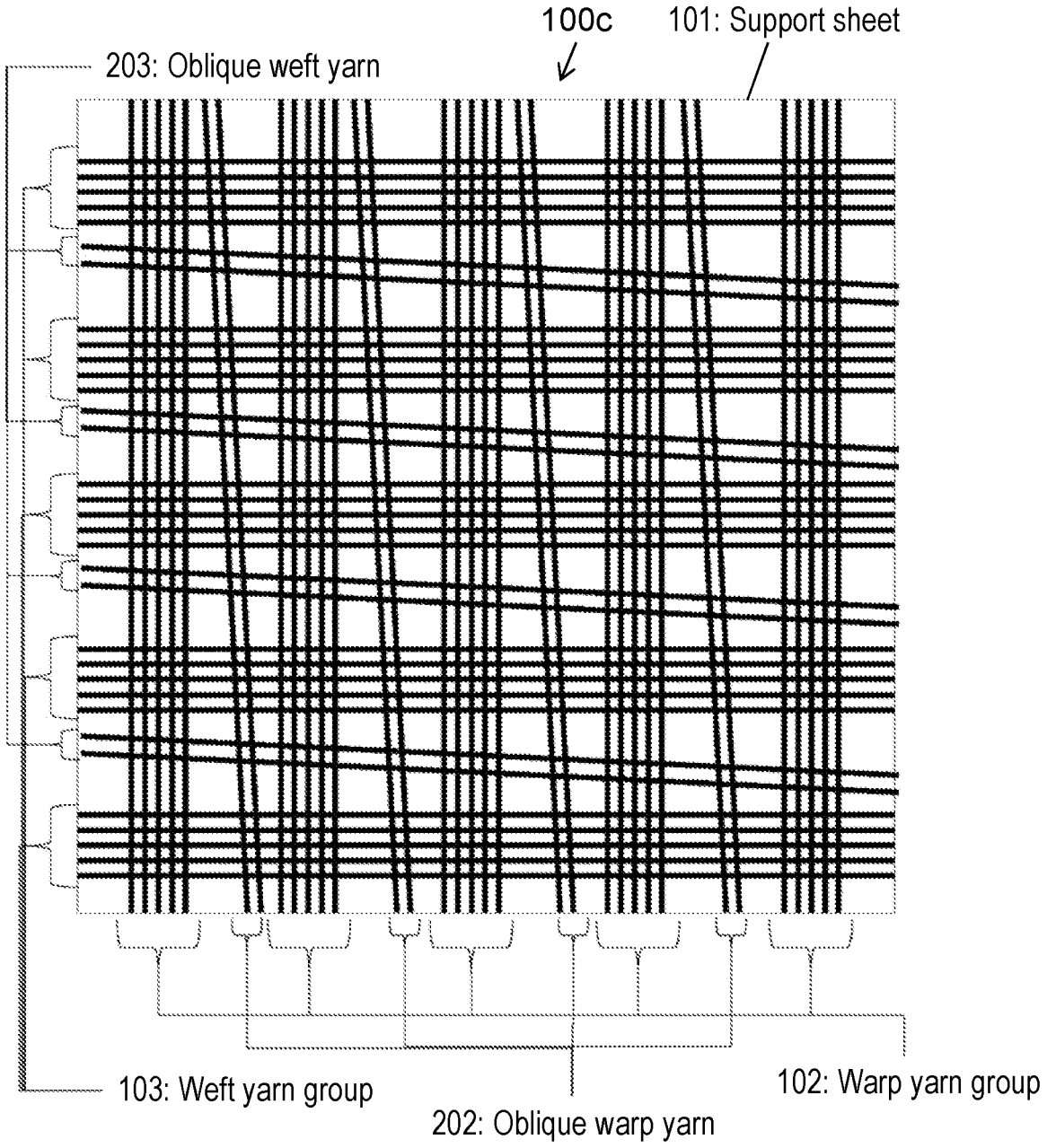
FIG. 7 is an enlarged schematic view of a fiber assembly according to a third modification of the first embodiment, in which both a warp yarn group and a weft yarn group have a pattern of high fiber density and a pattern of low fiber density and oblique warp yarns and oblique weft yarns are provided.
Figure 8:
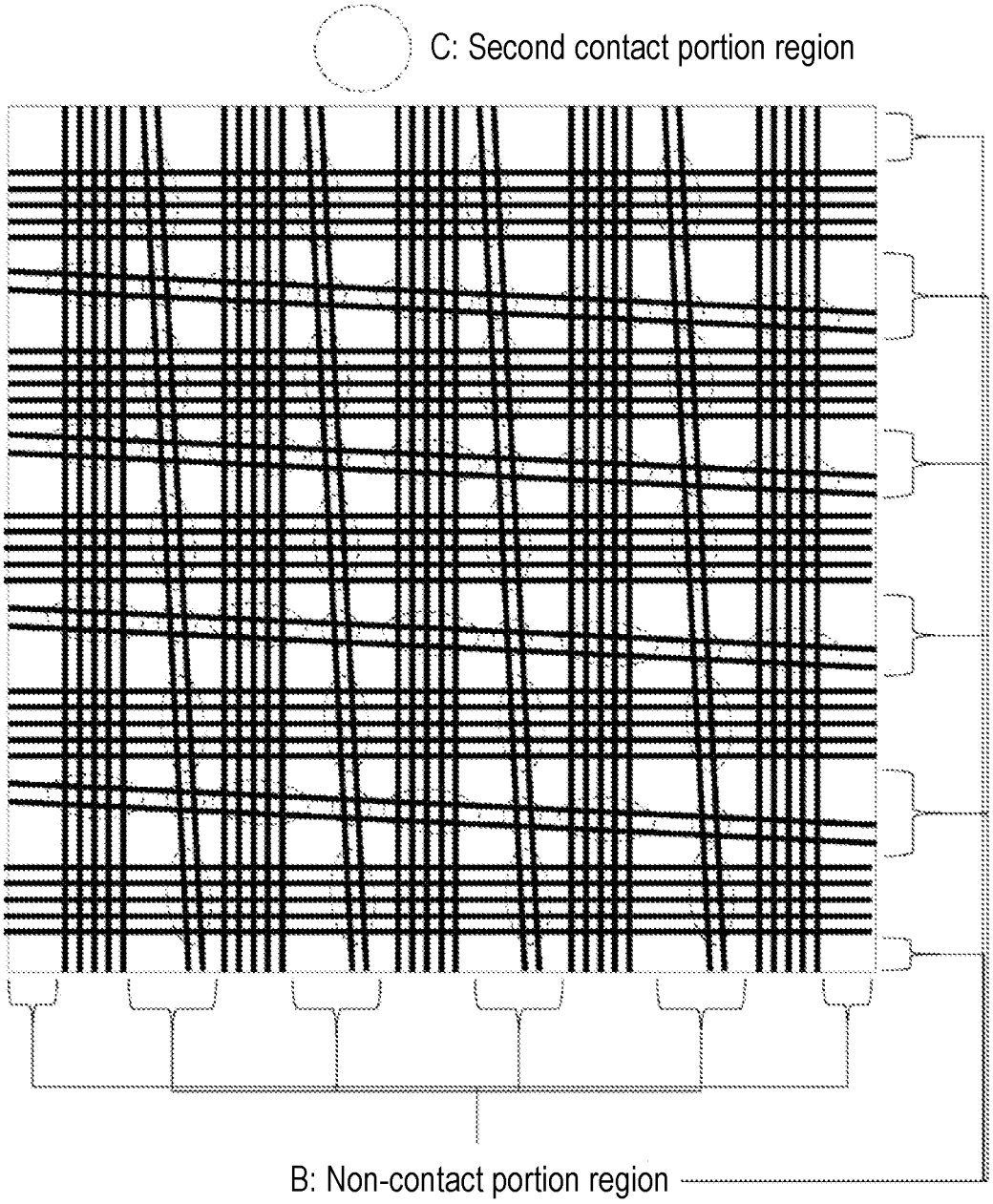
FIG. 8 is a schematic view showing a division of first contact portion regions, non-contact portion regions, and second contact portion regions in the case of FIG. 7.

FIG. 7 is a schematic view of fiber assembly 100*c* according to a third modification of the first embodiment, in which both warp yarn group 102 and weft yarn group 103 have a pattern of high fiber density and a pattern of low fiber density, and oblique warp yarns 202 and oblique weft yarns 203 are provided. FIG. 8 is a schematic view showing a division between first contact portion regions A, non-contact portion regions B, and second contact portion regions C in the case of FIG. 7.

In FIG. 7, a portion having a high fiber density of warp yarn group 102 has a spacing of 5 μm between the warp yarns and a portion having a low fiber density has a spacing of 2000 μm between the warp yarns. Similarly, a portion having a high fiber density of weft yarn group 103 has a spacing of 5 μm between the weft yarns, and a portion having a low fiber density has a spacing of 2000 μm between the weft yarns.

As shown in FIG. 7, two oblique warp yarns 202 that are not parallel to the warp yarns are sandwiched between two adjacent dense portions of warp yarn group 102. Two oblique weft yarns 203 that are not parallel to weft yarn group 103 are sandwiched between two adjacent dense portions of weft yarn group 103. Although oblique weft yarns 203 and weft yarn group 103 are not parallel to each other, an angle formed therebetween is small, and is, for example, 30 degrees or less. Accordingly, as shown in FIG. 8, non-contact region B includes second contact portion regions C in which oblique warp yarns 202 are integrated with the weft yarns and oblique weft yarns 203 are integrated with the warp yarns.

As described above, the spacing between the yarns in the portion having a high fiber density is preferably 5 μm to 1000 μm, and may be 5 μm to 500 μm, 5 μm to 200 μm, etc.

As described above, the spacing between the yarns in the portion having a low fiber density is preferably 2000 μm or more.

Effects

Here, as shown in FIGS. 6 and 8, although the non-contact portion region includes second contact portion regions C, when the number of oblique warp yarns or oblique weft yarns that are not parallel to the warp yarns or the weft yarns and that are surrounded by the dense portions of the warp yarn group or the weft yarn group is reduced to about 1 to 3, cut fibers of the divided portion are less likely to be entangled in the portion having a high fiber density, that is, first contact portion region A by cutting the fiber assembly into individual pieces in the portion having a low fiber density, that is, non-contact portion region B.

First Contact Portion Region

Figure 9:
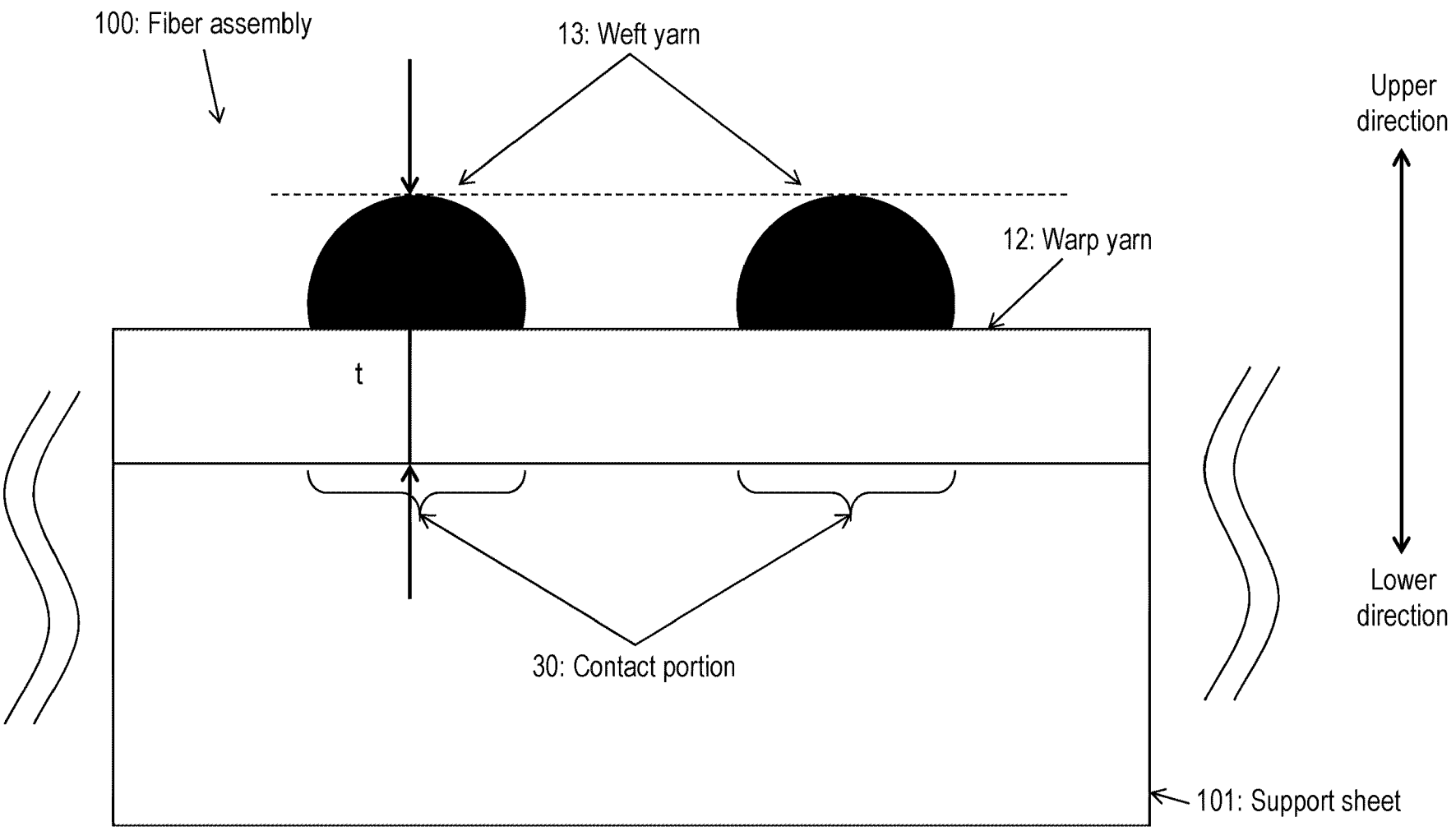
FIG. 9 is a schematic cross-sectional view of an enlarged cross-sectional structure viewed from a plane perpendicular to a thickness direction of a part of the first contact portion region of the fiber assembly according to the first embodiment.

Next, FIG. 9 is a schematic cross-sectional view of an enlarged cross-sectional structure viewed from a direction perpendicular to a thickness direction of a part of first contact portion region A of the fiber assembly according to the first embodiment.

Average thickness t of contact portion 30 between warp yarn 12 and weft yarn 13 of fiber assembly 100 according to the first embodiment is 3 μm.

Here, average thickness t of the contact portion means an average of a sum of a thickness of warp yarn 12 and a thickness of weft yarn 13 at contact portion 30 where warp yarn 12 is integrated with weft yarn 13.

In order to make a lattice formed by warp yarn group 102 and weft yarn group 103 thin and smooth, it is preferable to reduce the thickness of the contact portion to be integrated by a heat treatment as described later.

When average diameters of portions other than the contact portion of warp yarn 12 and weft yarn 13 are set as a and b respectively, average thickness t of contact portion 30 is preferably 80% or less of a sum (a+b), that is, 0.8×(a+b), from the viewpoint of ensuring the strength of contact portion 30 due to substantial flattening accompanying heat fusion described later.

A lower limit thereof can be appropriately determined, by a party concerned, to such an extent that openings designed in a lattice formed by gaps do not disappear, with respect to the materials constituting warp yarn group 102 and weft yarn group 103 and the size and position of the openings.

Regarding the smoothness, since weft yarn 13 is always present in an upward direction with respect to warp yarns 12 in a cross section of contact portion 30, a thin and smooth state can be maintained.

That is, if weft yarn 13 and warp yarn 12 are present not only in the upward direction but also in a downward direction in contact portion 30, the smoothness is impaired, which is not preferable. For the smoothness, it is preferable that the thicknesses of weft yarn 13 and warp yarn 12 are the same at contact portion 30 by making warp yarn 12 and weft yarn 13 having the same average diameter.

Adhesion of Individually Cut Fiber Group to Container

Next, FIGS. 10A to 10D are schematic views of a mode in which a fiber group is adhered to a container from the fiber assembly according to the first embodiment through a frame body.

Figure 10A:
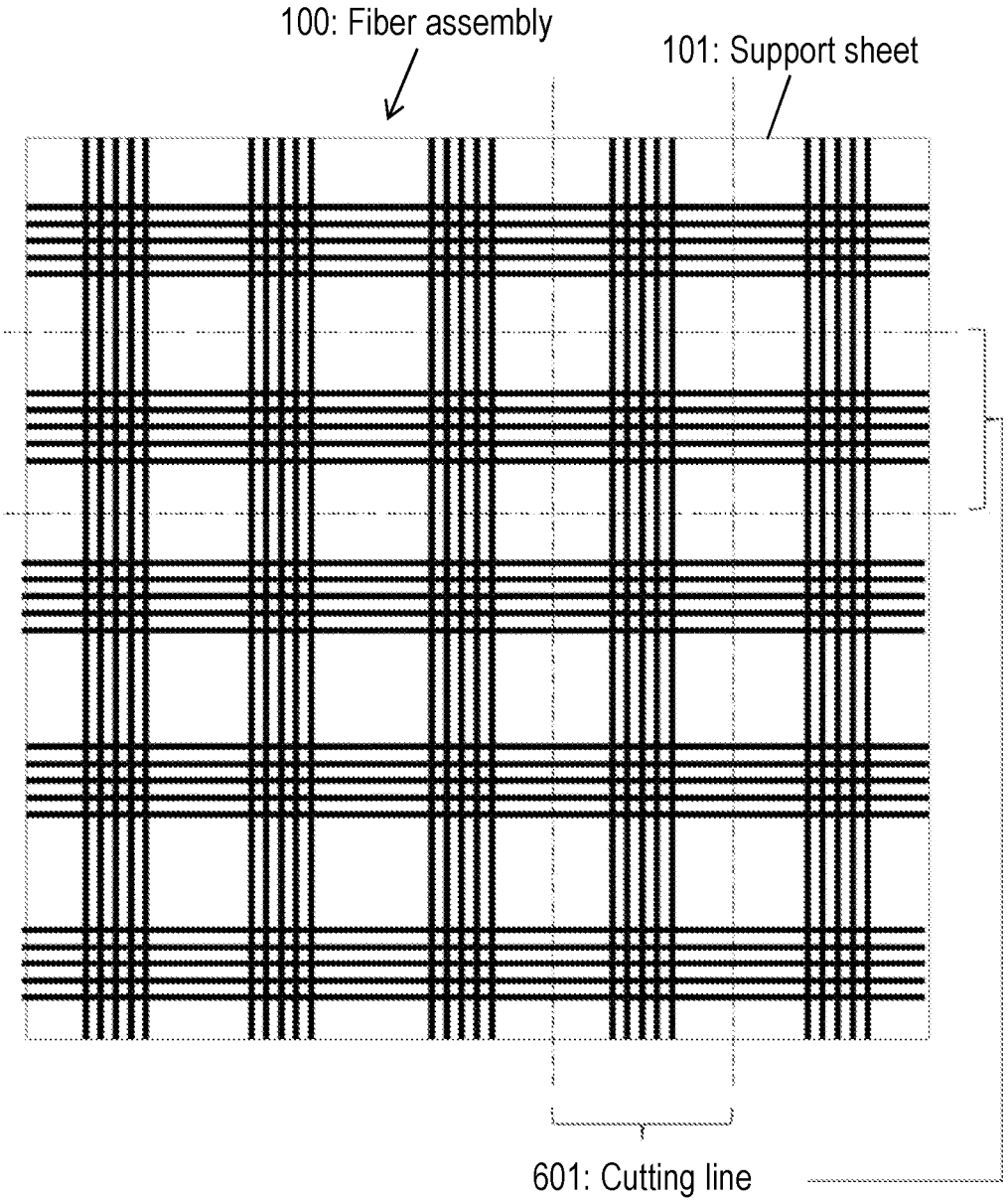
FIG. 10A is a schematic view showing cutting lines at the time when portions for practical use are to be cut into individual pieces from the fiber assembly according to the first embodiment.

FIG. 10A is a schematic view showing cutting lines 601 at the time when portions for practical use are to be cut into individual pieces from fiber assembly 100 according to the first embodiment.

As described above, by cutting the fiber assembly at the portion having a low fiber density, the cut fibers of the divided portion are less likely to be entangled in the portion having a high fiber density.

Figure 10B:
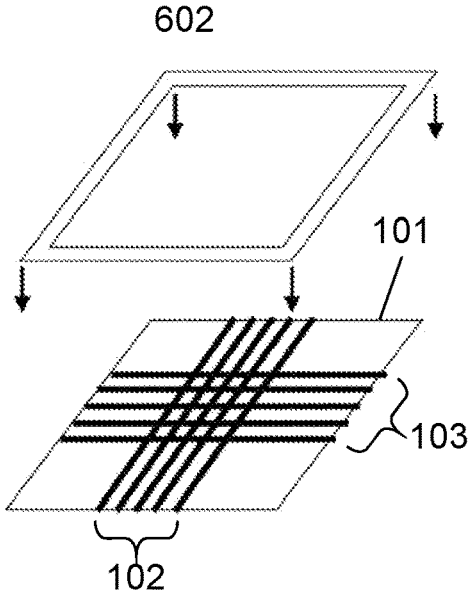
FIG. 10B is a perspective view showing a part of an operation of pressing and adhering a frame body to an individually cut piece in FIG. 10A.

FIG. 10B is a perspective view showing a part of an operation of pressing and adhering frame body 602 to an individually cut piece in FIG. 10A.

Figure 10C:
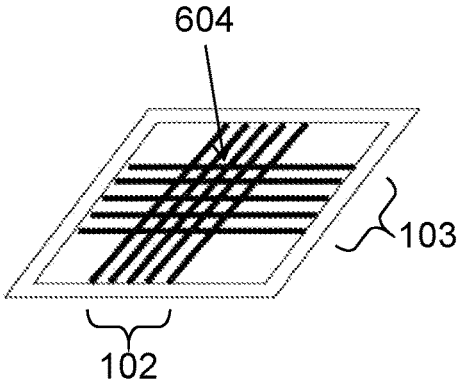
FIG. 10C is a perspective view after the frame body in FIG. 10B is peeled off from a support sheet.

FIG. 10C is a perspective view after frame body 602 in FIG. 10B is peeled off from support sheet 101.

An adhesive layer (not shown) is applied on a surface of frame body 602 on the side facing a main surface of a support sheet including warp yarn group 102 and weft yarn group 103, and when frame body 602 is pressed against support sheet 101 and then peeled off, fiber group 604 including warp yarn group 102 and weft yarn group 103 can be transferred to the adhesive layer of frame body 602.

Figure 10D:
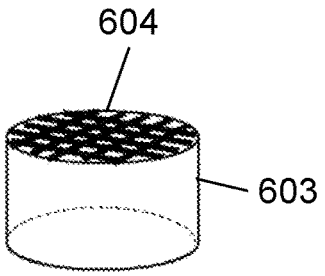
FIG. 10D is a perspective view in which a fiber group self-supporting via the frame body in FIG. 10C is adhered to an opening surface of a container.

FIG. 10D is a perspective view in which fiber group 604 self-supporting via frame body 602 in FIG. 10C is adhered to an opening surface of container 603.

In the first embodiment, polystyrene is used for container 603, and fiber group 604 is adhered to container 603 by being thermocompression bonded to the opening surface of the container, but fiber group 604 may not be adhered by thermocompression bonding and may be adhered via an adhesive, for example.

Spinning Device

Figure 11:
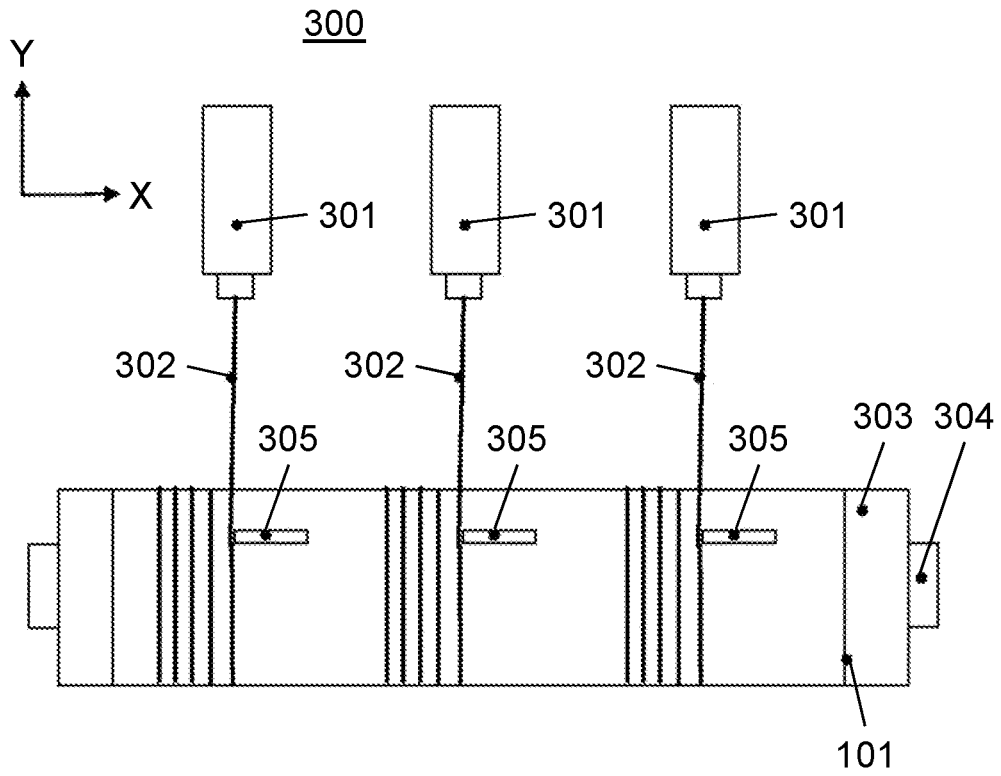
FIG. 11 is a schematic diagram showing a configuration of an example of a spinning device for producing the fiber assembly according to the first embodiment.
Figure 12:
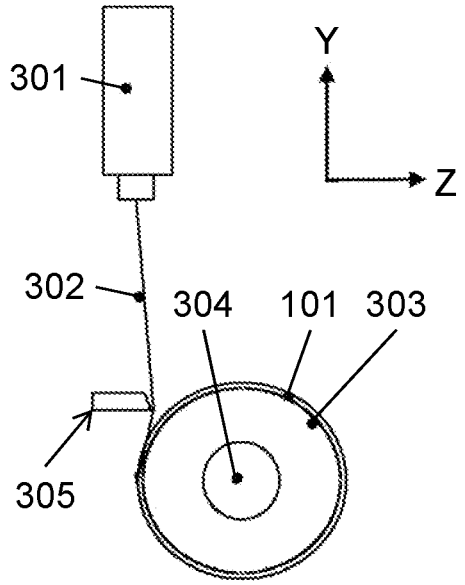
FIG. 12 is a side view of the spinning device in FIG. 11 as viewed from a direction (X direction) of a rotation shaft of a winding drum.

FIG. 11 is a schematic diagram showing a configuration of an example of a spinning device for producing the fiber assembly according to the first embodiment. The spinning device shown in FIG. 11 forms a warp yarn group and a weft yarn group on support sheet 101. FIG. 12 is a side view of spinning device 300 of FIG. 11 as viewed from a direction (X direction) of a rotation shaft of winding drum 303.

In FIG. 12, for convenience, the direction of the rotation shaft of winding drum 303 is defined as an X direction, a vertically upward direction is defined as a Y direction, and a direction from a front side to a back side in FIG. 7 is defined as a Z direction.

Spinning device 300 includes a plurality of nozzles 301, winding drum 303, guides 305, and a nozzle moving unit.

A polymer material is extruded in a molten or solution state by nozzle 301.

Winding drum 303 winds fiber 302 formed of the polymer material, which is extruded from nozzle 301 and is naturally cooled or naturally dried, in a unicursal manner.

Guide 305 regulates a winding position of fiber 302 on winding drum 303.

Nozzle 301 is relatively moved in a direction parallel to rotation shaft 304 of winding drum 303 by the nozzle moving unit (not shown).

In spinning device 300, nozzle 301 moves together with guide 305.

By spinning device 300, a polymer material such as polystyrene is extruded from nozzle 301 in a solution state by being swollen with an organic solvent or in a molten state by being heated, and fiber 302 in a solid state is formed by being naturally cooled or naturally dried.

According to spinning device 300, since nozzle 301 moves together with guide 305, a resistance frictional force that the guide receives from the fiber during the movement is extremely small.

Therefore, even fine fiber 302 having a diameter of about 1 μm to 10 μm can be accurately arranged at a uniform pitch on winding drum 303 without breaking.

By controlling the pitch at the time when nozzle 301 is moved in the direction parallel to rotation shaft 304 of winding drum 303, a gap can be formed between the yarns.

The plurality of nozzles 301 are arranged along the direction parallel to rotation shaft 304 of winding drum 303.

As shown in FIGS. 5 and 7, there are one to three oblique warp yarns that are not parallel to the warp yarns and that are sandwiched between two adjacent dense portions of the warp yarn group, or there are one to three oblique weft yarns that are not parallel to the weft yarns and that are sandwiched between two adjacent dense portions of the weft yarn group. Here, when only one nozzle 301 is used, it is necessary to move nozzle 301 from a portion having a high fiber density to a portion having a low fiber density. The above-described oblique warp yarns and oblique weft yarns are produced, for example, when the nozzle moves through pitches of sparse portions between the dense portions. In contrast, as shown in FIG. 11, when a plurality of nozzles 301 are used, since nozzles 301 do not move from a portion having a high fiber density to a portion having a low fiber density, no yarns are sandwiched between the dense portions. Therefore, by cutting the fiber assembly in the portion having a low fiber density, cut fibers in a divided portion are less likely to be entangled in the portion having a high fiber density, which is preferable.

Method for Producing Fiber Assembly

Figure 13:
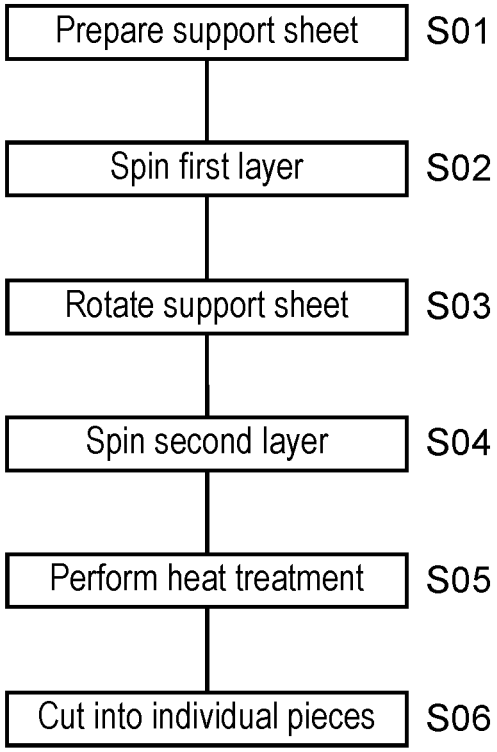
FIG. 13 is a flowchart of steps in a method for producing the fiber assembly according to the first embodiment.

Next, FIG. 13 is a flowchart of a method for producing the fiber assembly according to the first embodiment. Hereinafter, the method for producing the fiber assembly will be described.

(1) S01 is a step of preparing a support sheet.

Specifically, for example, a PET film having a thickness of 75 μm is wound on winding drum 303 of spinning device 300 as described above. A surface of the PET film preferably has appropriate peelability by fluorine treatment or the like.

This is because the support sheet needs to have an adhesive function with respect to fiber 302 when fiber 302 is spun on the support sheet in steps S02 and S04 described later, and the support sheet needs to have a property of allowing fiber group 604 to be peeled off therefrom in step S05 in order to treat fiber group 604 as a self-supporting film later.

(2) S02 is a step of spinning a first layer.

Using spinning device 300, a polymer material in a molten state by being heated or in a solution state by being swollen with an organic solvent is applied to the support sheet prepared in S01 in the same direction in a thin line.

Here, the polymer material supplied in a molten or solution state is naturally cooled or naturally dried to form fibers only in a solid state.

In the first embodiment, by using a solution obtained by swelling pellet-shaped polystyrene in DMF (N,N-dimethylformamide) that is an organic solvent and controlling a moving speed of nozzle 301 with respect to a rotation speed of winding drum 303, fibers having a diameter of 2 μm are applied at a gap spacing of 5 μm.

(3) S03 is a step of rotating the support sheet, on which the first layer is spun in step S02, at a predetermined angle in the same plane.

In the present embodiment, the support sheet is rotated by 90° to form a lattice in which the first layer spun in step S01 and a second layer to be spun in S04, which will be described later, are substantially orthogonal to each other.

The rotation angle may be 30° to 150°, and from the viewpoint of maintaining the shape of the lattice against an external force, the first layer and the second layer are preferably brought into contact with each other in a manner of intersecting at an angle of 90°.

(4) S04 is a step of spinning the second layer on the support sheet rotated by 90° in step S03.

A polymer material in a molten state by being heated or in a solution state by being swollen with an organic solvent is applied to the support sheet prepared in S03 in the same direction in a thin line.

In the first embodiment, similarly to step S02, polystyrene having low cytotoxicity is used as a polymer material, and by using a solution obtained by swelling pellet-shaped polystyrene in DMF (N,N-dimethylformamide) that is an organic solvent, and controlling the moving speed of nozzle 301 with respect to the rotation speed of winding drum 303, fibers having a diameter of 2 μm are applied at a gap spacing of 5 μm.

(5) S05 is a step of heating the fibers produced until step S04 on the support sheet. Specifically, the fibers are heated on the support sheet for a certain period of time at a temperature equal to or higher than a melting point of the polymer material (polystyrene in the embodiment). Thus, when the first layer in contact with the support sheet and a bottom portion of the second layer are in a molten state, a shape thereof is kept constant even in the molten state due to interfacial tension between the surface of the support sheet and the polymer. As a result, the bottom portion of the second layer in a molten state sinks into an upper portion of the first layer in a molten state, integration due to heat fusion is secured, and at least a part of the bottom portions of the first layer and the second layer becomes substantially flat.

Further, by heating the fibers on the support sheet, the mode of sinking of the second layer with respect to the first layer in a cross section of a contact portion between the first layer and the second layer is that, with regard to the contact portion, the second layer is the uppermost surface when a spinning surface is viewed as an upper surface. On the other hand, with regard to the contact portion, when a surface to be spun is viewed as the upper surface, the first layer is the uppermost surface, and it is possible to maintain the smoothness by maintaining the vertical relationship between the layers.

Here, for convenience, the first layer corresponds to the warp yarn group and the second layer corresponds to the weft yarn group, but the weft yarn group may be the first layer and the warp yarn group may be the second layer.

(6) S06 is a step of cutting a portion having a low fiber density of the fiber assembly produced until step S05 into individual pieces.

For example, in order to use a fiber group for an application portion, for example, in order to use a fiber group as the above-described scaffold material of cells, a portion having a low fiber density on an outer periphery of a portion having a high fiber density, which is specified in advance to a desired size, is cut into individual pieces using scissors or the like.

The fiber group obtained by the individual cutting can be used for transferring and adhering a fiber group to a desired portion in the manner described with reference to FIGS. 10B to 10D.

Here, when a contact surface with the application portion needs to be flat, the bottom portion side of the first layer may be disposed on the contact surface side. In particular, when there is no restriction on the shape with the contact surface, the bottom portion side of the first layer may be disposed on the contact surface side, or the upper portion side of the second layer may be disposed on the contact surface side.

Appropriate combinations of any embodiment and/or example among the various embodiments and/or examples described above are within the scope of the present disclosure, and effects of the respective embodiments and/or examples can be achieved.

INDUSTRIAL APPLICABILITY

According to the fiber assembly and the method for producing the fiber assembly according to the invention, since handling properties of the fiber assembly including fibers, which are thin and accurately arranged, are improved, the fiber assembly can be applied to various applications.

What is claimed is:

1. A fiber assembly comprising:

a support sheet;

a warp yarn group in which warp yarns including a polymer material are arranged; and a weft yarn group in which weft yarns including a polymer material are arranged, wherein:

a surface of the support sheet is release treated;

the warp yarn group is on the surface of the support sheet;

the weft yarn group is on the surface of the support sheet;

the warp yarn group and the weft yarn group define contact portion regions and non-contact portion regions;

in each of the contact portion regions, at least one of the warp yarns is integrated with at least one of the weft yarns;

each of the warp yarns has a line width of 1 μm to 10 μm, inclusive;

each of the weft yarns has a line width of 1 μm to 10 μm, inclusive;

at least one of the contact portion regions has a fiber density which is higher than a fiber density of at least one of the non-contact portion regions;

in at least one of the contact portion regions, two of the warp yarns or two of the weft yarns have a spacing of 5 μm or more and 1000 μm or less;

in at least one of the non-contact portion regions, two of the warp yarns or two of the weft yarns have a spacing of 2000 μm or more;

average diameters of portions other than a contact portion in which the at least one of the warp yarns is integrated with the at least one of the weft yarns, are defined as a and b respectively;

an average thickness t of the contact portion is 80% or less of a sum of (a+b); and in a cross section of the contact portion, the weft yarns extend only in an upward direction above the warp yarns.

2. The fiber assembly according to claim 1, wherein:

the contact portion regions are first contact portion regions;

the warp yarn group is a first warp yarn group;

the warp yarns of the first warp yarn group are non-oblique warp yarns;

the fiber assembly further comprises a second warp yarn group;

the second warp yarn group includes oblique warp yarns;

the oblique warp yarns are not parallel to the non-oblique warp yarns; and at least one of the non-contact portion regions includes a second contact portion region in which at least one of the oblique warp yarns is integrated with at least one of the weft yarns.

3. The fiber assembly according to claim 2, wherein the at least one of the oblique warp yarns includes three or less of the oblique warp yarns.

4. The fiber assembly according to claim 1, wherein:

the contact portion regions are first contact portion regions;

the weft yarn group is a first weft yarn group;

the weft yarns of the first weft yarn group are non-oblique weft yarns;

the fiber assembly further comprises a second weft yarn group;

the second weft yarn group includes oblique weft yarns;

the oblique weft yarns are not parallel to the non-oblique weft yarns; and at least one of the non-contact portion regions includes a second contact portion region in which at least one of the oblique weft yarns is integrated with at least one of the warp yarns.

5. The fiber assembly according to claim 4, wherein the at least one of the oblique weft yarns includes three or less of the oblique weft yarns.

* * * * *